US005573636A

United States Patent [19]

Sack et al.

[11] Patent Number: 5,573,636

[45] Date of Patent: Nov. 12, 1996

[54] RECYCLABLE SUPPORT MATERIAL

[75] Inventors: Wieland Sack, Bissendorf; Karl-Hermann Krauss, Leipzig; Reiner Mehnert, Markkleeberg; Peter Klenert, Leipzig, all of Germany

[73] Assignee: Felix Schoeller jr Papierfabriken GmbH & Co. KG, Osnabruck, Germany

[21] Appl. No.: 190,651

[22] Filed: Feb. 1, 1994

[30] Foreign Application Priority Data

Feb. 1, 1993 [DE] Germany ..... 43 02 678.8

[51] Int. Cl.[6] ..... D21C 5/02

[52] U.S. Cl. ..... 162/5; 162/164.1; 162/181.1; 428/327

[58] Field of Search ..... 162/4, 5, 57, 225, 162/135, 136, 158, 164.1, 168.1, 181.2, 181.1; 427/331, 384, 391, 395; 428/323, 327

[56] References Cited

U.S. PATENT DOCUMENTS

| | | | |
|---|---|---|---|
| 3,718,536 | 2/1973 | Downs et al. | 162/225 |
| 4,188,259 | 2/1980 | Mamers et al. | 162/4 |
| 4,384,040 | 5/1983 | von Meer | 430/532 |
| 4,844,777 | 7/1989 | Anthonsen et al. | 162/135 |
| 4,994,147 | 2/1991 | Foley et al. | 162/137 |

FOREIGN PATENT DOCUMENTS

| | | |
|---|---|---|
| 4105368 | 5/1992 | Germany . |
| 4042225 | 7/1992 | Germany . |
| 4139251 | 6/1993 | Germany . |

OTHER PUBLICATIONS

A. J. Felton, "The process & economics . . . wood fiber recovery" TAPPI, May 1975, vol. 58, #5, pp. 71–73.

Japanese Patent Abstract Sec. C, vol. 16 (1192) No. 118 (C–922).

*Primary Examiner*—Donald E. Czaja
*Assistant Examiner*—Dean T. Nguyen
*Attorney, Agent, or Firm*—Lockwood, Alex, Fitzgibbon & Cummings

[57] ABSTRACT

A recyclable support material and process of recycling the support material is disclosed in which the support material comprises a cellulose containing carrier and a radiation cured layer, and the radiation cured layer contains a solid which can be anchored to a limited extent. This support material can be reprocessed and recycled by aqueous reprocessing processes which are conventional within the paper industry.

14 Claims, 2 Drawing Sheets

RECYCLABLE SUPPORT MATERIAL

BACKGROUND AND DESCRIPTION OF INVENTION

The present invention relates to a recyclable support material comprising a cellulose containing carrier and at least one polymeric water resistant layer, as well as a process for the recycling of the support material.

It is known that support materials with polymeric water resistant layers on cellulose containing carriers are difficult to recycle.

One support material which is frequently used is a laminate of thermoplastic polymers, mostly polyethylene and paper. Known products of this type are, for example, beverage packaging materials and photographic support materials. The process of recycling them breaks these support materials down into the individual components in order to obtain the components in the purest possible form and to make them accessible in a separate process to reuse. This is described, for example, in the published German patent applications DE 4 105 368 and DE 4 042 225.

The development and optimization of such recycling processes have still not on the whole been fully achieved. Moreover, prior processes entail considerable expense in the practice of the process technology.

Radiation cured layers on cellulose containing carriers have become more widespread in various technical areas in recent years. These areas include photographic support materials, thermal recording materials, packaging materials, decorative and overlay papers, and separating and interleaving papers. These cellulose containing carriers with radiation cured layers can also have additional functional layers, such as, for example, barrier layers, image receiving layers, prints, metallic vapor deposits and the like.

In these product applications the suitability of use benefits from the chemical resistance (and non-destructibility) of the cured layers. For example, neither image carriers nor kitchen papers (decorative papers) are intended to rapidly wear out. Nevertheless the scrap which occurs in production, such as for example upon start up of a coating machine, accumulates in the individual production stages of these products. Therefore, it would be highly desirable from both economic and environmental viewpoints if this scrap or waste could to the greatest extent possible be completely conveyed back into the materials cycle.

However, the radiation cured layers, cannot be removed from the cellulose containing carriers, as is possible in the case of thermoplastic polyethylene. They are also not dissolvable in aqueous or organic solvents, and during a mechanical crushing of the layer material, either fragments accumulate which are too large or the crushing process must be carried out in such an intensive manner that the fibers of the cellulose containing carrier lose their functionality.

It is, therefore, an object of the present invention to make available a recyclable layer material comprising a cellulose containing carrier, and at least one polymeric water resistant layer which without additional expense can be conveyed back into the production stream by means of equipment and processes which are conventional in the paper industry.

BRIEF DESCRIPTION OF THE DRAWINGS

In the course of the subsequent description of the invention reference will be made to the drawings in which.

DESCRIPTION OF THE PREFERRED EMBODIMENTS

Figure 1A:
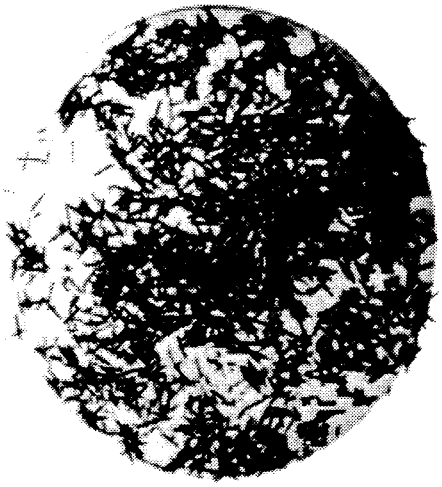
FIGS. 1A–1F are video printouts of formation tests of products which were prepared in accordance with Examples 1A–1F to follow.
Figure 1B:
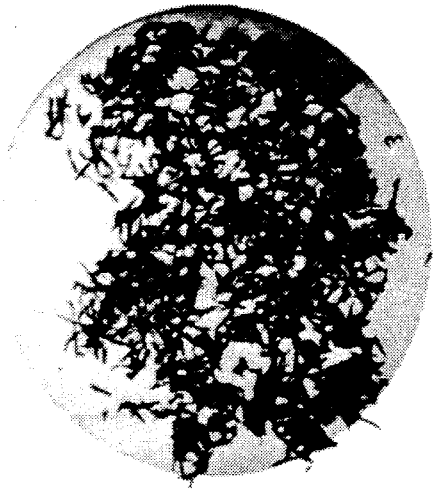
Figure 1C:
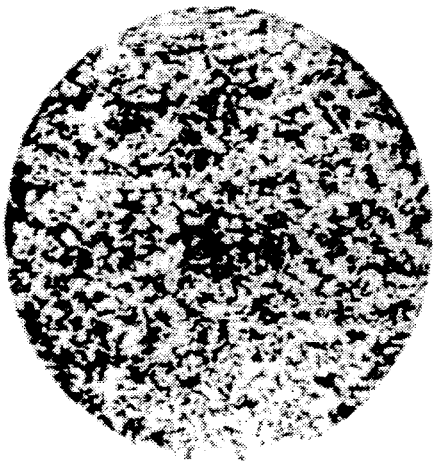
Figure 1D:
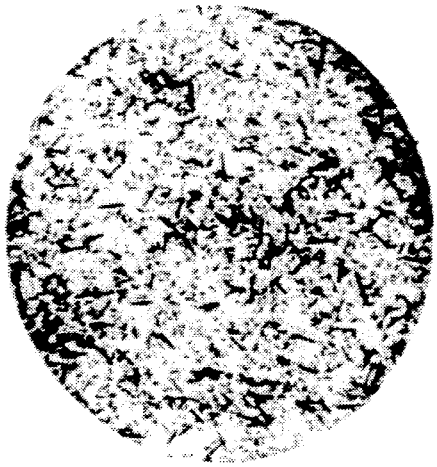
Figure 1E:
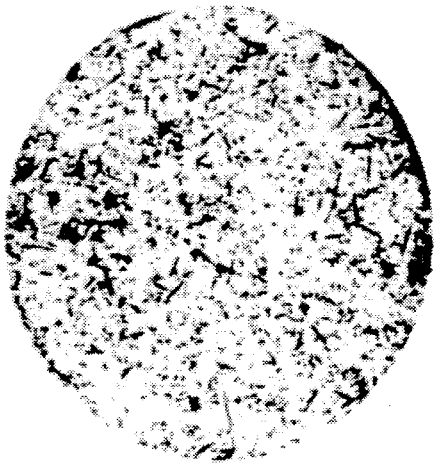
Figure 1F:
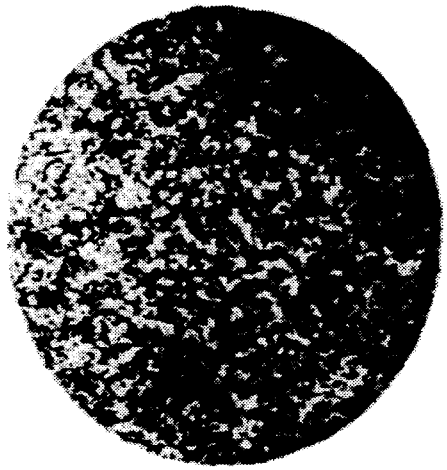

The object of the invention is achieved by means of a layer material of a cellulose containing carrier and at least one polymeric water resistant layer which comprises at least one radiation curable bonding agent and solid materials which can be anchored therein to only a limited extent. It was surprising that the admixing of these solid materials facilitates the mechanical destructibility of the layers without impairing their suitability for use, and that the aggregate materials which are produced can be conveyed without residues back into the aqueous system of the manufacturing process without the application of technology in addition to that which is already used in the relevant paper industry. The materials which are used as radiation curable bonding agents are varnishes of monomers, oligomers or prepolymers, and preferably mixtures of these groups. It is monomers which serve primarily as diluting agents. Monomers can be advantageously dispensed with if the coating masses are processed at elevated temperatures of preferably from 30° C. to 60° C. The monomers, oligomers and prepolymers contain carbon double bonds (>C=C<), as acryl, methacryl, allyl or vinyl compounds. They can additionally contain hydroxyl, carboxyl and other polar groups, for example for the improvement of the adhesion on the cellulose containing carrier.

The solid materials which result in only limited anchoring in the radiation curable bonding agents are those which are very difficult to dissolve or insoluble in the bonding agent system (varnish). They are characterized, for example, by a very smooth surface, a slight affinity to the bonding agent, a high wetting angle relative to the bonding agent, a disadhesive character, or the like. Those solid materials which are effective in accordance with the invention in their structural or energetic effects are, for example, starches and starch derivatives, gelatins, microcrystalline cellulose and cellulose ether, mannogalactanes, polyvinyl alcohol, polyacrylamide, polyvinylidene chloride, polyolefin wax, polyamides, melamine or urea formaldehyde resins. Solid materials which have uniform and finely grained structures, such as rice starch, arrowroot starch or microspheres, are especially preferred.

The greater the portion is of these solid materials in the radiation cured layer, the simpler or better is the recyclability of the layer materials. Thus, for example, layers which contain 70 weight % hollow microspheres were successfully applied and recycled. In order to achieve a distinct improvement in the recyclability, a minimum quantity of about 3 weight % solid materials which can be anchored to a limited extent is necessary. The quantity of 3 weight % is to be considered as the minimum. For many radiation curable layers, however, these quantities are insufficient and a higher weight % is needed.

Incorporated inorganic pigments (white pigments) or filling agents will improve the recyclability of such layers only to a distinctly lesser extent than the solid materials in accordance with the invention. If a radiation cured layer already has high contents of >50 weight % of white pigments, for example, then 3 weight % of the solid material in accordance with the invention is sufficient, whereas for layers which are free of inorganic pigments, at least 10 weight % of solid material in accordance with the invention is required. Such inorganic white pigments or filling agents which can be present in quantities of up to 80 weight % in the polymeric water resistant layer are carbonates, oxides, sulfates or sulfites of calcium, magnesium, barium, strontium, tin or titanium.

Inorganic pigments which are completely encapsulated by products in accordance with the invention, or organic compounds, such as for example silicones, which are not solid bodies, but can be used as solid bodies through the encasing of inorganic pigments, and therefore can have only a limited anchoring within the radiation curable bonding agents are considered to be substances in accordance with the invention.

Materials which can expand in water are considered to be a particularly preferred class of solid materials in accordance with the invention. These are, for example, starch, gelatin, mannogalactane, cellulose ether, polyvinyl alcohol, polyacrylamide. In the aqueous systems of the recycling processes of the paper industry these preferred substances facilitate the decomposition of the layer by their swelling.

In addition the layers can contain up to 20 weight % of other auxiliary materials, such as dispersion agents, coloring materials, antistatic agents, optical brighteners, matting agents, aromatic agents, wetting agents, defoaming agents, etc.

The radiation curable bonding agents are cured by means of high energy radiation. This radiation may be an electron beam or UV radiation. During the use of UV lamps, photoinitiators must be added to the bonding agent for the formation of radicals which start the curing reaction.

The finished mixture can be applied to the carrier material with conventional application apparatus, such as blade, die, gravure, roll or print coaters.

Many of the solid materials in accordance with the invention, however, have such a coarse grain size distribution that they bring about disturbances during the application of the finished mixture to the cellulose containing carriers. .Technical crushing processes can provide some assistance. However, this expense can be avoided for solid materials which can swell in water, if these are previously swollen in water, homogenized, and then mixed with the radiation curable bonding agent. Surprisingly, it is possible in a number of specific technical applications to mix the organic bonding agent (varnish) with the aqueous swelling agent in such a manner that a layer produced therefrom can be applied on paper or cardboard with very good adhesion, flexibility and surface. Layer materials which are produced in this manner have distinct advantages in the recycling process which is described here.

It is also surprising that it is possible to add aqueous dispersions of microspheres to the organic bonding agent. These mixtures also yield radiation cured layers of good quality and uniformity. The layer materials thus produced can be advantageously recycled.

If the layer material described above comprising a cellulose containing carrier with a radiation cured layer which contains solid materials which can be anchored to a limited extent, is coated with additional layers which are not radiation cured, then the following statements can be made in regard to the recycling:

a) If a thermoplastic polymer is applied as an additional layer, such as for example polyethylene, then the total product can be processed with precision as a pure polyethylene-paper layer material. That is to say, the thermoplastic layer is separated from the remaining layer material and separately recycled and the remaining support material is recycled in accordance with the invention.

b) If a releasable layer is applied as an additional layer, then it can be removed and the rest can be recycled in a manner in accordance with the invention.

c) If a water soluble or water swellable layer is applied as an additional layer, then it can be recycled in accordance with the invention.

The aqueous recycling process can comprise the following process steps:

1st Step: The impacting and crushing (pulping) of the layer material in a pulper 2nd Step: The defibrating and grinding of the impacted pulped material in a refiner, such as a disk-type refiner;

3rd Step: The admixing of the material thus processed with a virgin paper stock.

Between each of the process steps 1 and 2 and the process steps 2 and 3, sorting can be performed, for example by means of a vortex-type cleaner, centrifugal cleaner or turboseparator, to remove contaminants and foreign materials. In one preferred process variant, the layer fragments are separated from the pure cellulose fibers by flotation or sifting and conveyed to a separate fine grinding apparatus such as in a ball mill and then subsequently added into the system.

The first process step of the recycling process is advantageously carried out in an alkaline aqueous solution of bleaching liquor with a content of solid material of between 10 and 30 weight %. At the end of this process step, the solution is neutralized. The second process step is advantageously carried out at slightly elevated temperatures in the range of 30° C. to 607C.

Such recyclable support material of cellulose containing carriers and radiation cured, water resistant layers applied on one or on both sides have diverse applications. They can be directly printed on and/or coated or impregnated with resins, whereby the resins can also be radiation curable bonding agents for use as decorative, core and overlay paper. They can also be used as image carrier materials following the application of additional receptive layers. They can also be used for packaging materials following the application of thermoplastics and/or foils, such as polyethylene and aluminum foil. They also can be used as adhesive, separating of interleaving papers following the application of release agents, such as silicones.

The following examples should clarify, but not restrict the invention.

EXAMPLE 1

A photographic base paper of 180 g/m$^2$ basis weight and naturally sized with alkylketene dimer was coated on one side with the coating masses 1B to 1F after a Corona-type pretreatment. The coating weight was 25±2 g/m$^2$.

| | |
|---|---|
| 1A | Uncoated base paper (as a comparison) |
| 1B | Coated by melt extrusion with pigmented polyethylene (as a comparison) |
| 1C to 1F | Coated with a radiation curable coating mass as follows: |

-continued

| Mass | Bonding Agent | Titanium dioxide (RS-34 from Montedison) | Other |
|---|---|---|---|
| 1C | 50 weight % | 40 weight % | 10 weight % rice starch |
| 1D | 50 weight % | 30 weight % | 20 weight % rice starch |
| 1E | 45 weight % | 30 weight % | 25 weight % dispersion of microspheres (50 weight % aqueous acrylate polystyrene dispersion, Ropaque HP-91) |
| 1F | 70 weight % | 0 weight % | 30 weight % CMC-preswelling (30 weight % aqueous preswelling of carboxymethyl cellulose, Tylose C-30 from Hoechst over 16 hours at room temperature) |

The bonding agent is a mixture of the following:

44 weight.% of aliphatic urethane acrylate (IRR 143 from UCB-Chemie, Belgium)

40 weight % of tripropylene glycol diacrylate 16 weight % of polyester acrylate (EB 657 from UCB-Chemie, Belgium The samples 1C to 1F were cured in an electron beam curing apparatus at a machine speed of 20 m/min and an energy level of 20 kJ/kg and under an inert gas (nitrogen).

EXAMPLE 2

A paper of 135 g/m$^2$ basis weight was sized with stearic acid, alkylketene dimer and epoxidized fatty acid amide. An additional surface sizing was applied in the sizing press of the paper machine of polyvinyl alcohol and carboxymethyl cellulose (ratio=2:1). After a Corona-type pretreatment, this was coated with 25±2 g/m$^2$ of the following coating masses:

| Coating Ingredients | Weight Percent 2A | 2B | 2C | 2D |
|---|---|---|---|---|
| Trimethylol propane triacrylate | 35 | | | 20 |
| Tripropylene glycol diacrylate | | 50 | 28 | 30 |
| Pentaerythritol triacrylate | 25 | | | |
| Polyester acrylate (as in Example 1) | | | 8 | |
| Acrylated acryl-copolymer (EB 1701 from UCB-Chemie) | | | 4 | |
| Titanium dioxide (as in Example 1) | 40 | | | |
| Titanium dioxide (R-FD-1 from Bayer) | | 40 | 55 | |
| Arrowroot starch | | 10 | | |
| Rice starch | | | 5 | |
| Dispersion of microspheres (as in Example 1) | | | | 50 |

Example 2A serves as the comparison.

All of the samples were processed under the conditions described in Example 1.

TEST METHODS

Formation 5 g of the sample to be tested as produced in Example 1 are cut into strips of 4×12 cm in size. After the addition of 200 ml of water, these strips are additionally crushed in the disintegration unit (IKA-RE 166) at 6000 RPM for 10 minutes. The fiber pulp which is produced thereby is supplemented with water up to 5 liters, and is formed in a sheet forming device (Rapid Koethen system) into a paper sheet. After the drying of the paper sheet, an image of the fiber structure is recorded with a CCD video camera with the transmitted light at high contrast. This image, after reduction by the scale of 1:2, is then printed out on a video printer. The images which are printed out are tested by means of a visual comparison.

Content of Residual Specks

Strips of the sample as produced in Example 2 (4×12 cm) are crushed to a 12.5% stock consistency. 2.25% of active chlorine and 2.00% of sodium hydroxide at 50° C. are added, and this material is defibrated in a pulper device with a Helio-Rotor at 730 RPM. At 15 minute intervals samples are removed, the excessive chlorine content is bound with sodium sulfite, and the content of residual specks is measured with a Brecht/Holl device.

Out of a number of the examples in accordance with the invention, samples with a coating of the base paper on both sides were also produced and tested. The test results were only altered to an insignificant degree relative to the samples coated on one side.

The video printouts of the formation tests of Examples 1A–1F are shown in FIGS. 1A–1F, respectively. The formation tests show in particular the finer crushing of the samples in accordance with the invention. It is surprising that the results are even better in the invention Examples 1C–1F, as shown in FIGS. 1C–1F, than those of the uncoated base paper of Example 1A as shown in FIG. 1A.

Figure 2:
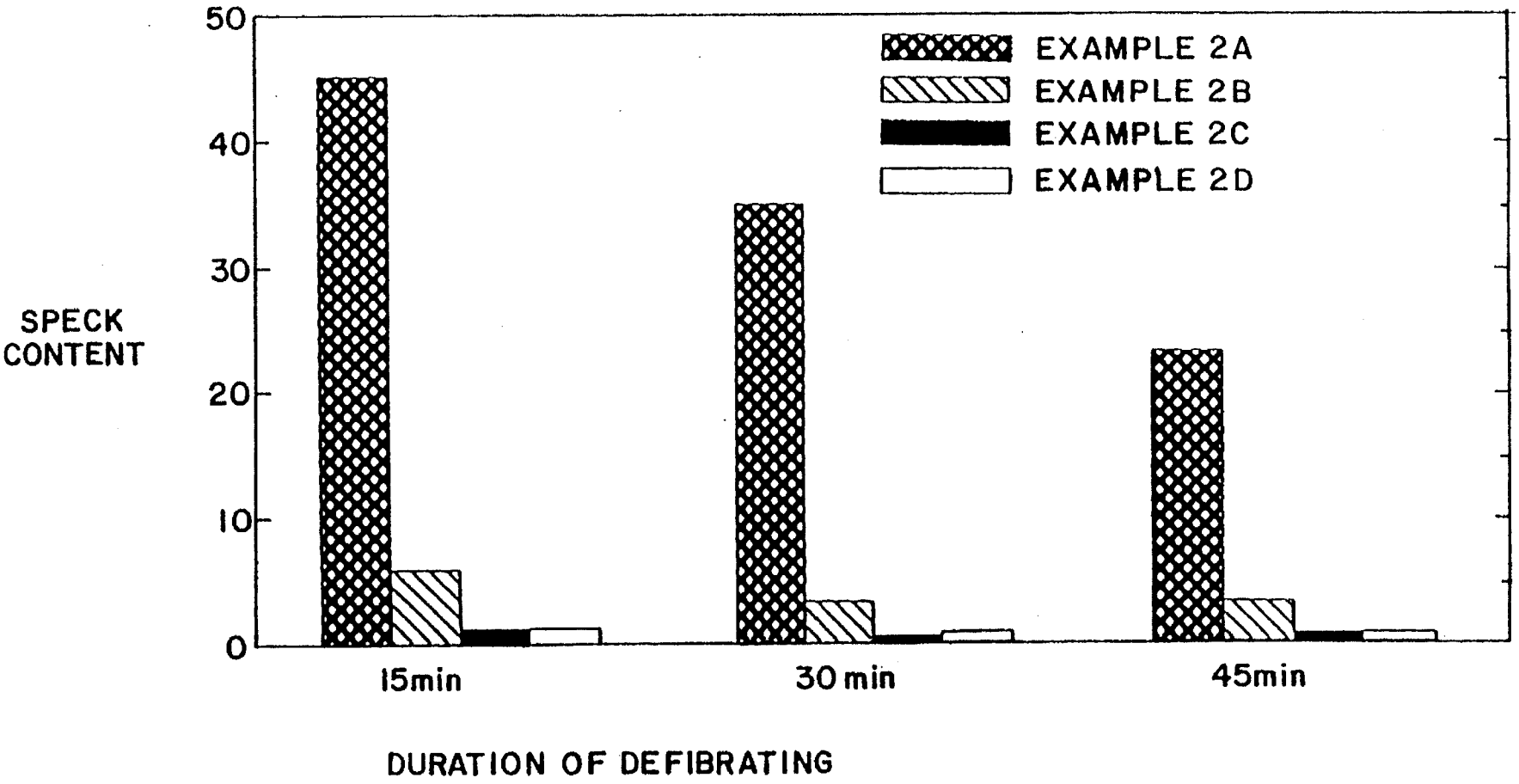
FIG. 2 shows the results of residual speck content tests of products which were prepared in accordance with Examples 2A–2D to follow.

The results of the residual speck content test are shown in FIG. 2. The content of residual specks shows the rapid recyclability of the samples in accordance with the invention. The results after 15 minutes of Examples 2B–2D of the invention are already significantly better than those of the comparison Example 2A after 45 minutes as shown in FIG. 2.

We claim:

1. A recyclable support material comprising a cellulose containing, generally flat carrier and at least one polymeric water resistant layer, said layer comprising at least one radiation cured bonding agent, and a solid material in said layer which is substantially insoluble in said bonding agent, said solid material is present in an amount of 3–80% by weight of the polymeric water resistant layer, and wherein said solid material is selected from the group consisting of starch, starch derivatives, gelatin, microcrystalline-cellulose, cellulose ether, mannogalactane, polyvinyl alcohol, polyacrylamide, polyvinylidene chloride, polyolefin wax, polyamide, melamine resin, urea resin, acrylate polystyrene and inorganic pigments completely encapsulated with at least one of said solid materials or silicones.

2. The support material of claim 1, wherein said solid material is a solid material which swells in water.

3. The support material of claim 1, wherein said solid material is microspheres.

4. The support material of claim 1, wherein said solid material is of uniform and small particle sizes.

5. The support material of claim 1, wherein said radiation cured bonding agent is formed from the group consisting essentially of one or more monomers, oligomers and prepolymers.

6. The support material of claim 1, wherein said radiation cured bonding agent is formed in the absence of monomers.

7. The support material of claim 1, wherein said radiation cured bonding agent is cured by one or more curable compounds selected from the group consisting of vinyl, allyl, acryl and methacryl compounds.

8. The support material of claim 1, wherein said radiation cured bonding agent is a cured varnish which is cured by high energy electron beam or UV radiation.

9. The support material of claim 1, wherein said polymeric water resistant layer also contains up to 80 weight % of an inorganic white pigment.

10. The support material of claim 9, wherein said white pigment is selected from the group consisting of carbonates, oxides, sulfates and sulfites of calcium, magnesium, barium, strontium, zinc and titanium.

11. The support material of claim 9, wherein said white pigment is titanium dioxide.

12. The support material of claim 1, wherein said polymeric water resistant layer contains up to 20 weight % of one or more auxiliary agents selected from the group consisting of dispersing agents, colorants, antistatic agents, optical brighteners, matting agents, aromatic agents, wetting agents and defoaming agents.

13. The support material of claim 1, wherein said solid material is swelled in water and homogenized before addition to the radiation curable bonding agent.

14. The support material of claim 1, wherein said solid material is in an aqueous dispersion prior to addition to the radiation curable bonding agent.

* * * * *

UNITED STATES PATENT AND TRADEMARK OFFICE

CERTIFICATE OF CORRECTION

PATENT NO. : 5,573,636

DATED : November 12, 1996

INVENTOR(S) : Wieland Sack, Karl-Hermann Krauss, Reiner Mehnert and Peter Klenert It is certified that error appears in the above-indentified patent and that said Letters Patent is hereby corrected as shown below:

Col. 1, line 48, after "layers" delete the comma ",".
Col. 4, line 35, delete "607C" and insert --60°C--; line 46, delete "of" and insert --or--.
Col. 5, line 25, delete "weight.%" and insert --weight %--.

Signed and Sealed this

Twenty-eighth Day of October, 1997

Bruce Lehman

*Attest:*

BRUCE LEHMAN

*Attesting Officer*

*Commissioner of Patents and Trademarks*